US009405267B2

(12) United States Patent
Lee et al.

(10) Patent No.: US 9,405,267 B2
(45) Date of Patent: Aug. 2, 2016

(54) DEVELOPING APPARATUS HAVING PUSHING UNIT AND IMAGE FORMING APPARATUS HAVING THE SAME

(71) Applicant: Samsung Electronics Co., Ltd, Suwon-si, Gyeonggi-do (KR)

(72) Inventors: Han-jun Lee, Goyang-si (KR); Jin-ho Park, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/334,894

(22) Filed: Jul. 18, 2014

(65) Prior Publication Data

US 2015/0023695 A1 Jan. 22, 2015

(30) Foreign Application Priority Data

Jul. 19, 2013 (KR) ..... 10-2013-0085179

(51) Int. Cl.

*G03G 15/08* (2006.01)
*G03G 21/16* (2006.01)
*G03G 21/18* (2006.01)

(52) U.S. Cl.

CPC ..... *G03G 21/1676* (2013.01); *G03G 21/1825* (2013.01)

(58) Field of Classification Search

CPC ..... G03G 21/1676; G03G 21/1825
USPC ..... 399/119, 228
See application file for complete search history.

(56) References Cited

U.S. PATENT DOCUMENTS 4,740,767 A * 4/1988 Kawano et al. ..... 399/119
4,851,873 A * 7/1989 Sakao et al. ..... 399/119
4,860,053 A * 8/1989 Yamamoto et al.
4,870,456 A * 9/1989 Watanabe et al.
8,306,454 B2 * 11/2012 Kinoshita
2010/0142994 A1 6/2010 Kinoshita
2012/0321342 A1 12/2012 Mori

FOREIGN PATENT DOCUMENTS

JP 62005276 A * 1/1987

OTHER PUBLICATIONS

Extended European Search Report dated Dec. 15, 2014 from European Patent Application No. 14174954.9, 5 pages.

* cited by examiner

*Primary Examiner* — Walter L Lindsay, Jr.
*Assistant Examiner* — Milton Gonzalez
(74) *Attorney, Agent, or Firm* — Staas & Halsey LLP

(57) ABSTRACT

A developing apparatus includes a developing unit having a developing member, a photosensitive unit hinge-connected to the developing unit and having an image carrier, and a pushing unit disposed below the photosensitive unit and configured to selectively push a lower portion of the developing unit, wherein the pushing unit includes a pushing member disposed to move linearly in a base and having an end configured to be in contact with the lower portion of the developing unit, a link member having a first end connected to the pushing member, a crank arm rotatably connected to a second end of the link member, an elastic member disposed on the link member and that elastically supports the pushing member, and a rotation shaft rotatably disposed in the base and connected to the crank arm.

13 Claims, 11 Drawing Sheets

FIG. 1
CONVENTIONAL
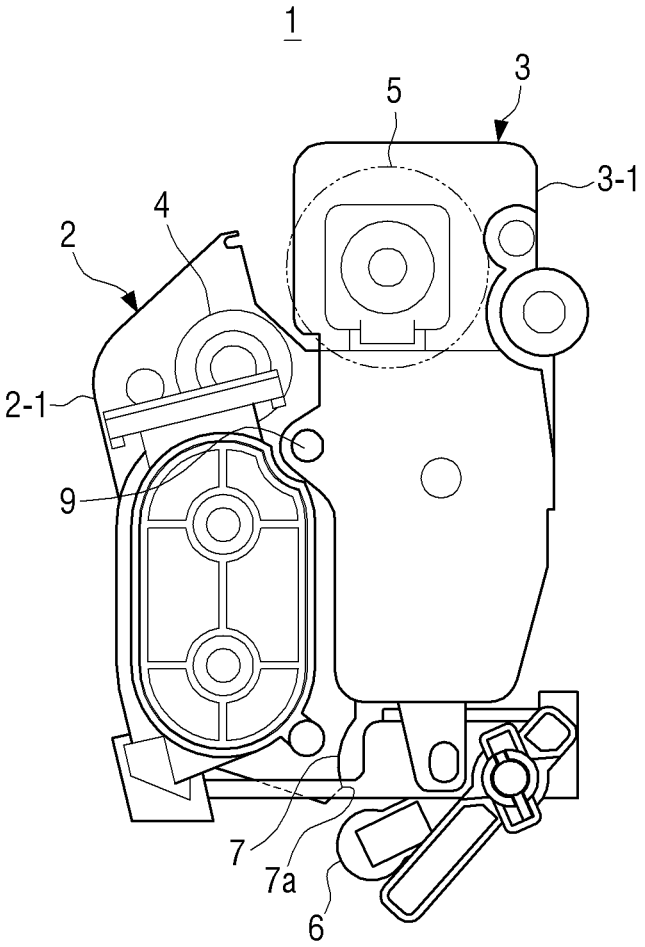

FIG. 2
CONVENTIONAL
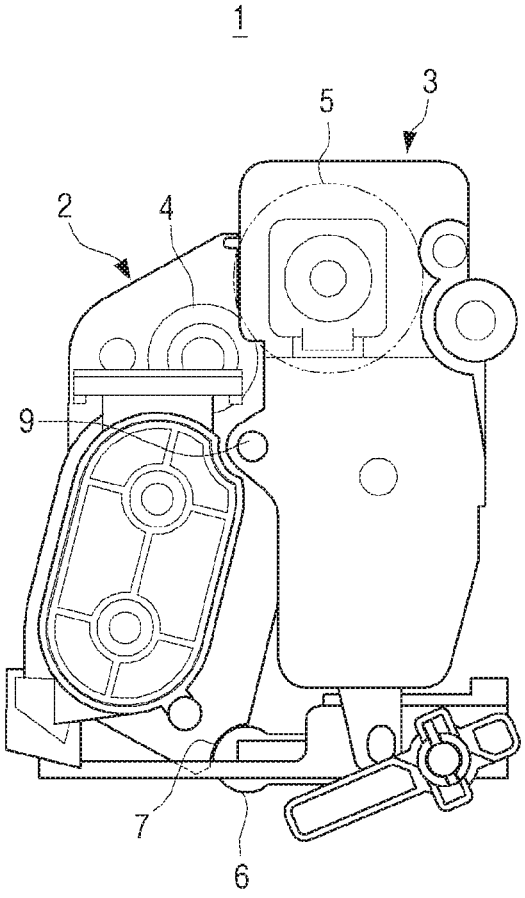

DEVELOPING APPARATUS HAVING PUSHING UNIT AND IMAGE FORMING APPARATUS HAVING THE SAME

CROSS-REFERENCE TO RELATED APPLICATIONS

This application claims the benefit of priority under 35 U.S.C. §119(a) to Korean Patent Application No. 10-2013-0085179, filed Jul. 19, 2013, in the Korean Intellectual Property Office, the content of which is incorporated herein in its entirety by reference.

BACKGROUND OF THE INVENTION

1. Field of the Invention

The present general inventive concept generally relates to a developing apparatus that includes a developing unit and a photosensitive unit. More particularly, the present general inventive concept relates to a developing apparatus that includes a pushing unit that can allow a developing member of a developing unit to be in contact with or to be spaced apart from an image carrier of a photosensitive unit, and an image forming apparatus having the same.

2. Description of the Related Art

Generally, since the lifetime of a photosensitive drum is shorter than the lifetime of a developing roller, if a photosensitive unit that includes a photosensitive drum and a developing unit that includes a developing roller are configured as a single unit, the developing unit, which has a longer life, may be discarded along with the photosensitive unit, which is wasteful. Also, in recent years, in order to reduce the size of an image forming apparatus, there has been a trend to use a structure in which the developing unit and the photosensitive unit can be separated from each other.

In a case in which the developing unit and the photosensitive unit can be separated from each other, there is a need for a structure that allows the developing roller of the developing unit to be selectively spaced apart from the photosensitive drum of the photosensitive unit.

FIGS. 1 and 2 illustrate a conventional developing apparatus 1. FIG. 1 illustrates a state in which a developing unit 2 is spaced apart from a photosensitive unit 3, and FIG. 2 illustrates a state in which the developing unit 2 is in contact with the photosensitive unit 3.

The developing unit 2 includes a developing housing 2-1 and a developing roller 4 disposed in an upper portion of the developing housing 2-1. The photosensitive unit 3 includes a photosensitive housing 3-1 and a photosensitive drum 5 disposed in an upper portion of the photosensitive housing 3-1. The developing unit 2 and the photosensitive unit 3 are connected by a hinge 9. Accordingly, the developing unit 2 and the photosensitive unit 3 can be rotated a predetermined angle on a shaft of the hinge 9.

A pushing lever 6 is disposed to be rotated a predetermined angle below the photosensitive unit 3, and a pressed portion 7, to be pressed by a front end of the pushing lever 6, is provided on a lower portion of the developing unit 2.

Accordingly, if the front end of the pushing lever 6 of the photosensitive unit 3 is inserted into the pressed portion 7 of the developing unit 2 by rotating the pushing lever 6, as illustrated in FIG. 1, a predetermined angle in a clockwise direction, the lower portion of the developing unit 2 receives a force in the left direction so that the developing unit 2 is rotated in the clockwise direction on the shaft of the hinge 9. Then, as illustrated in FIG. 2, the developing roller 4 of the developing unit 2 is in contact with the photosensitive drum 5 of the photosensitive unit 3 so that the developing unit 2 and the photosensitive unit 3 are in a state in which they are in contact. When the pushing lever 6 is rotated a predetermined angle in the counterclockwise direction from this state, the front end of the pushing lever 6 is removed from the pressed portion 7 so that the developing unit 2 is rotated in the counterclockwise direction on the shaft of the hinge 9. Then, the developing roller 4 of the developing unit 2 is spaced apart from the photosensitive drum 5 of the photosensitive unit 3 so that the developing unit 2 and the photosensitive unit 3 are in a state in which they are spaced apart.

As illustrated in FIGS. 1 and 2, the structure, in which the developing unit 2 is rotated a predetermined angle by using the pushing lever 6 so that the developing unit 2 is in contact with or spaced apart from the photosensitive unit 3, cannot operate smoothly because the operation of the pushing lever 6 to push the developing unit 2 depends on the mechanical configuration of the pushing lever 6 and the pressed portion 7 and because the direction of the force to rotate the pushing lever 6 is not matched with the direction of the force to push the developing unit 2. Specifically, a substantial amount of force is needed at the time when the pushing lever 6 goes over a projection 7*a* of the pressed portion 7.

Accordingly, there is a need for a developing apparatus that has a pushing structure that can smoothly push a developing unit, slowly increase force, and match a pushing direction of the developing unit with a pushing direction of a pushing lever.

SUMMARY OF THE INVENTION

The present general inventive concept has been developed in order to overcome the above drawbacks and other problems associated with the conventional arrangement. The present general inventive concept provides a developing apparatus and an image forming apparatus that have a pushing structure that is formed in a slider-crank structure to convert rotational movement into linear movement, thereby gradually pushing a developing unit in a smooth operation.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a developing apparatus that includes a developing unit having a developing member, a photosensitive unit hinge-connected to the developing unit and having an image carrier, and a pushing unit disposed below the photosensitive unit and configured to selectively push a lower portion of the developing unit, wherein the pushing unit may include a pushing member disposed to move linearly in a base and having an end configured to be in contact with the lower portion of the developing unit, a link member having a first end connected to the pushing member, a crank arm rotatably connected to a second end of the link member, an elastic member disposed on the link member and that elastically supports the pushing member. and a rotation shaft rotatably disposed in the base and connected to the crank arm.

The pushing member may include a pair of long grooves formed in a direction parallel to a moving direction of the pushing member, and the link member may include a guide projection formed at the first end of the link member, inserted in the pair of long grooves, and configured to move inside the pair of long grooves.

The pushing unit may further include an operating lever disposed at an end of the rotation shaft and configured to be rotated integrally with the rotation shaft and the crank arm.

When the operating lever is rotated in a direction, the elastic member may push the pushing member so that the developing unit is rotated by a certain angle, and when the operating lever is rotated in an opposite direction, a force with which the elastic member pushes the pushing member may be removed so that the developing unit returns to an original state.

An amount of compression of the elastic member may be configured to change according to an amount of rotation of the crank arm.

When the link member and the crank arm form a straight line, the elastic member may be compressed to a maximum.

The base may include a first stopper configured to limit a rotational movement of the crank arm.

When the crank arm is in contact with the first stopper, the pushing member may press the developing unit with an elastic force of the elastic member so that the developing member is in contact with the image carrier.

When the crank arm is in contact with the first stopper, a moving direction of the pushing member may be the same as a direction of the elastic force of the elastic member.

The base may include a pair of guide rails to guide a linear movement of the pushing member.

The base may further include a second stopper disposed at an end of at least one of the pair of guide rails and configured to limit the linear movement of the pushing member.

The lower portion of the developing unit and the pushing member may be formed to be in surface contact with each other.

The lower portion of the developing unit and the pushing member may be formed to be in point contact with each other.

When the pushing member pushes the developing unit, the developing member may be in contact with the image carrier of the photosensitive unit, and when the pushing unit does not push the developing unit, the developing member may be spaced apart from the image carrier.

The foregoing and/or other features and utilities of the present inventive concept also provide an image forming apparatus that may include a main body of the image forming apparatus, a paper feeding unit disposed inside the main body, an image forming unit having at least one developing apparatus and configured to transfer an image onto a print medium supplied from the paper feeding unit, and a fixing unit configured to fix the image transferred onto the print medium, wherein the at least one developing apparatus may include a developing unit having a developing member, a photosensitive unit hinge-connected to the developing unit and having an image carrier, and a pushing unit disposed below the photosensitive unit and configured to selectively push a lower portion of the developing unit, wherein the pushing unit may include a pushing member disposed to move linearly in a base and having an end configured to be in contact with the lower portion of the developing unit, a link member having a first end connected to the pushing member, a crank arm rotatably connected to a second end of the link member, an elastic member disposed on the link member and that elastically supports the pushing member, and a rotation shaft rotatably disposed in the base and connected to the crank arm.

The foregoing and/or other features and utilities of the present inventive concept also provide a pushing unit that includes a pushing member configured to move linearly in a first direction to cause a developing unit of a developing apparatus to rotate about a hinge to contact a photosensitive unit of the developing apparatus, a cam configured to rotate, and a link member coupled between the pushing member and the cam and configured to convert a rotation motion of the cam into a linear motion of the pushing member.

The pushing unit may further include an elastic member coupled between the pushing member and the cam and configured to apply a force to the pushing member to cause the linear motion of the pushing member in the first direction.

An amount of the force may be a function of an angle of rotation of the cam. The amount may be a maximum amount when the cam and the link member form a substantially straight line. When the amount is the maximum amount, the force applied to the pushing member may be entirely from the elastic member rather than from the cam and the link member.

The pushing unit may further include a first stopper configured to limit the linear motion of the pushing member in a second direction, the second direction opposite the first direction. When the pushing member is in contact with the first stopper, the developing unit may be configured to be spaced apart from the photosensitive unit, and the angle of rotation of the cam may be at an original angle.

The pushing unit may further include a second stopper configured to limit the rotation motion of the cam to limit the linear motion of the pushing member in the first direction. The angle of rotation of the cam, with respect to the original angle, when the cam is in contact with the second stopper may be greater than the angle of rotation of the cam, with respect to the original angle, when the cam and the link member form the substantially straight line.

Other objects, advantages and salient features of the present general inventive concept are apparent from the detailed description below taken in conjunction with the annexed drawings.

BRIEF DESCRIPTION OF THE DRAWINGS

These and/or other features and utilities of the present general inventive concept will become apparent and more readily appreciated from the following description of the embodiments, taken in conjunction with the accompanying drawings of which:

FIG. 1 illustrates a conventional developing apparatus in a state in which a developing roller is spaced apart from a photosensitive drum;

FIG. 2 illustrates the conventional developing apparatus of FIG. 1 in a state in which the developing roller is in contact with the photosensitive drum;

DETAILED DESCRIPTION OF THE EMBODIMENTS

Figure 3:
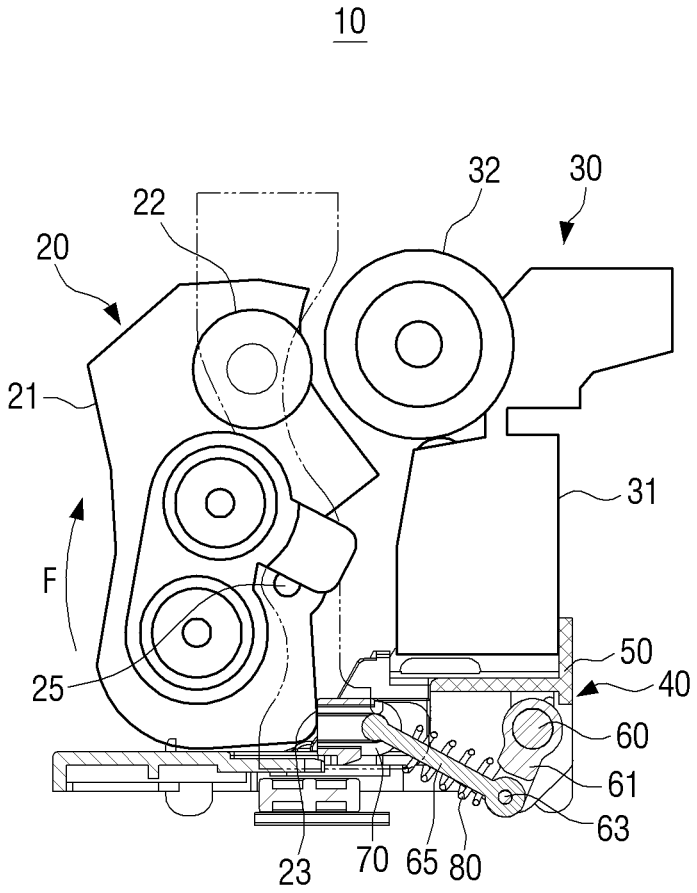
FIG. 3 illustrates a developing apparatus that has a pushing unit according to an embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased to assist in a comprehensive understanding.

Figure 4:
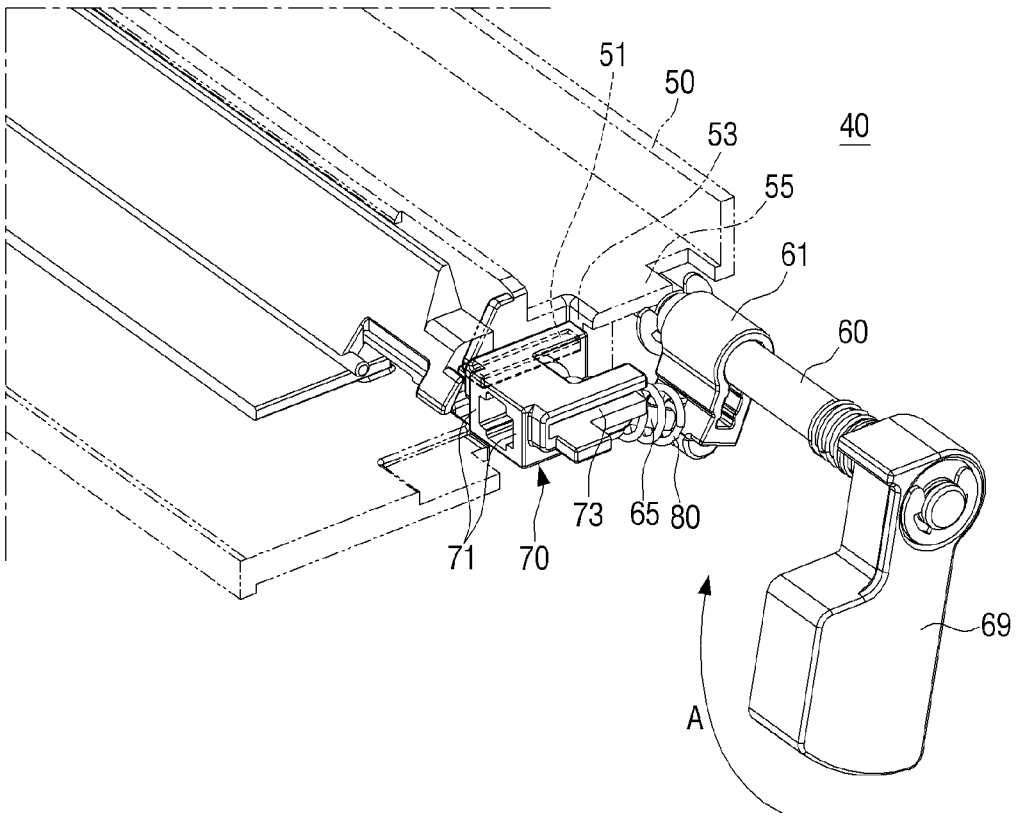
FIG. 4 is a partial perspective view that illustrates a state in which a pushing member of a pushing unit, according to an embodiment of the present inventive concept, does not push a developing unit.
Figure 5:
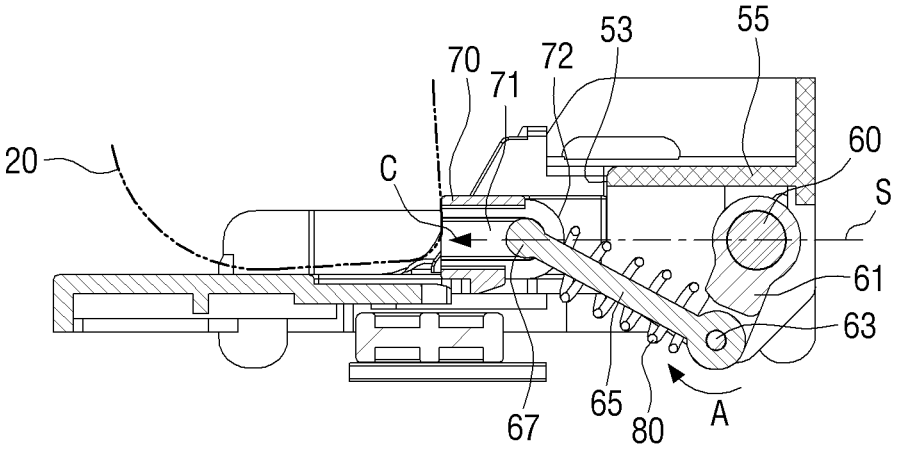
FIG. 5 is a partial sectional view that illustrates a state in which a pushing member of a pushing unit, according to an embodiment of the present inventive concept, does not push a developing unit.
Figure 6:
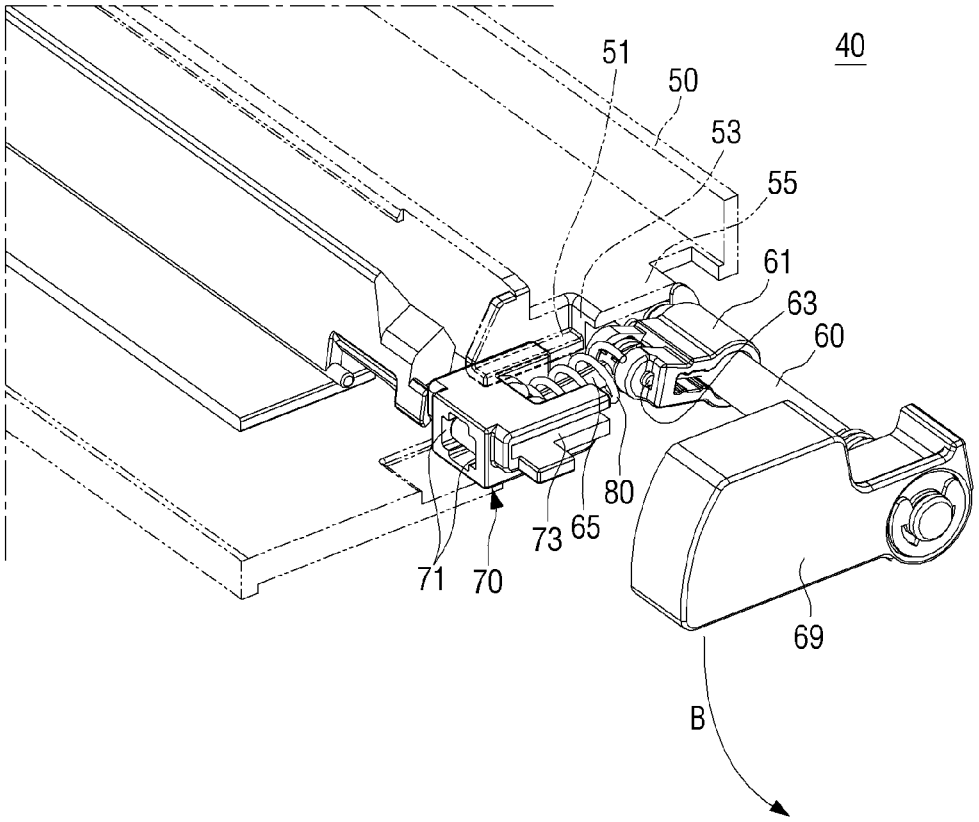
FIG. 6 is a partial perspective view that illustrates a state in which a pushing member of a pushing unit, according to an embodiment of the present inventive concept, pushes a developing unit.
Figure 7:
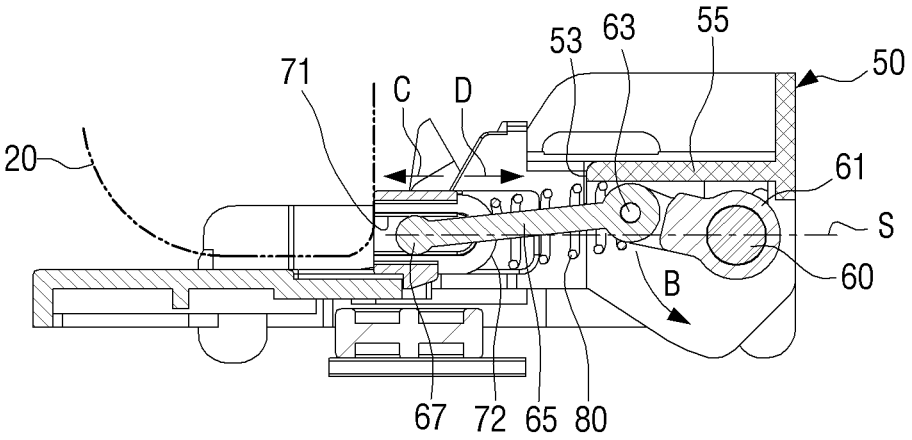
FIG. 7 is a partial sectional view that illustrates a state in which a pushing member of a pushing unit, according to an embodiment of the present inventive concept, pushes a developing unit.

FIG. 3 illustrates a developing apparatus that has a pushing unit according to an embodiment of the present inventive concept. FIG. 4 is a partial perspective view that illustrates a state in which a pushing member of a pushing unit, according to an embodiment of the present inventive concept, does not push a developing unit. FIG. 5 is a partial sectional view that illustrates a state in which a pushing member of a pushing unit, according to an embodiment of the present inventive concept, does not push a developing unit. FIG. 6 is a partial perspective view that illustrates a state in which a pushing member of a pushing unit, according to an embodiment of the present inventive concept, pushes a developing unit. FIG. 7 is a partial sectional view that illustrates a state in which a pushing member of a pushing unit, according to an embodiment of the present inventive concept, pushes a developing unit.

Referring to FIG. 3, a developing apparatus 10, according to an embodiment of the present inventive concept, may include a photosensitive unit 30, a developing unit 20, and a pushing unit 40.

The photosensitive unit 30 may include a photosensitive housing 31 and an image carrier 32. The image carrier 32 may be rotatably disposed in the photosensitive housing 31. An electrostatic latent image may be formed on a surface of the image carrier 32 by an exposure unit 150 (see FIG. 11). A photosensitive drum, for example, may be used as the image carrier 32. Also, the photosensitive unit 30 may be disposed to be able to be separated from the developing unit 20 and the pushing unit 40.

The developing unit 20 may be disposed to rotate on a hinge shaft 25 with respect to the photosensitive unit 30, and may include a developing housing 21 and a developing member 22. The developing housing 21 may be disposed to rotate on the hinge shaft 25. The developing member 22 may be rotatably disposed in an upper portion of the developing housing 21. A pressed portion 23, which may be subjected to a force by the pushing unit 40, may be provided on a lower portion of the developing housing 21. The developing member 22 may supply the image carrier 32 with developer stored in the developing unit 20 so that the electrostatic latent image may be developed into a developer image. A developing roller, for example, may be used as the developing member 22.

When the developing member 22 of the developing unit 20 is spaced apart from the image carrier 32 of the photosensitive unit 30, the photosensitive unit 30 may be separated from the developing unit 20 and the pushing unit 40. Accordingly, in a state in which the developing member 22 is spaced apart from the image carrier 32, the photosensitive unit 30 that contains a depleted image carrier 32 may be replaced with a new photosensitive unit 30.

The pushing unit 40 may be disposed below the photosensitive unit 30, and may be formed to push selectively a lower portion of the developing unit 20, namely, the pressed portion 23. If the pushing unit 40 is formed, for example, to have a slider-crank structure and to contain an elastic member, then the pushing unit 40 may gradually and stably push the developing unit 20.

Referring to FIGS. 3, 4, and 5, the pushing unit 40 may include a base 50, a rotation shaft 60, a crank arm 61, a link member 65, a pushing member 70, an elastic member 80, and an operating lever 69.

The base 50 may be provided below the photosensitive unit 30. The photosensitive unit 30 may be detachably disposed in the base 50. The base 50 may be formed to support the rotational movement of the rotation shaft 60 and the linear movement of the pushing member 70. The base 50 may have a length that corresponds to a width of the photosensitive unit 30 (the length of the base 50 may correspond to a length of the image carrier 32).

The rotation shaft 60 may be rotatably disposed in the base 50. The rotation shaft 60 may project from a side surface of the base 50. The operating lever 69 to rotate the rotation shaft 60 may be disposed at a projecting end of the rotation shaft 60. As the operating lever 69 is rotated, the rotation shaft 60 may be rotated integrally with the operating lever 69.

The crank arm 61 may be disposed in the rotation shaft 60. The crank arm 61 may be fixed to the rotation shaft 60 so that, as the rotation shaft 60 is rotated, the crank arm 61 may be rotated integrally with the rotation shaft 60. The crank arm 61 may be rotated by the same angle as the operating lever 69 to rotate the rotation shaft 60. Accordingly, if the operating lever 69 is rotated a certain angle, then the crank arm 61 may also be rotated by the same angle in the same direction as the operating lever 69.

The crank arm 61 may be formed, for example, so that the rotation thereof is limited by an upper wall 55 of the base 50. In an embodiment as illustrated in FIG. 7, when the crank arm 61 is rotated a certain angle in the clockwise direction, the upper wall 55 may interfere with one end of the crank arm 61 so that crank arm 61 may not be able to rotate further. In other words, the upper wall 55 of the base 50 may perform a function of a first stopper to limit an angle by which the crank arm 61 may be rotated in the clockwise direction.

Also, an angle up to which the crank arm 61 may be rotated in the counterclockwise direction may be limited in order to limit a moving distance of the pushing member 70. For this purpose, the first stopper (not illustrated) may be disposed to limit the counterclockwise rotation of the crank arm 61. However, the embodiment illustrated in FIG. 7 may exclude the first stopper to directly limit the counterclockwise rotation of the crank arm 61, but a second stopper 53 to directly limit the movement of the pushing member 70 may be disposed as is described below.

The link member 65 may be disposed between the crank arm 61 and the pushing member 70. A first end of the link member 65 may be connected to the pushing member 70, and a second end of the link member 65 may be connected to the one end of the crank arm 61. The second end of the link member 65 may be rotatably connected to the one end of the crank arm 61. In the embodiment illustrated in FIG. 7, the second end of the link member 65 and the one end of the crank arm 61 may be connected by a rotation pin 63 so that the link member 65 and the crank arm 61 may rotate freely with respect to each other.

A guide projection 67 that may be inserted into a long groove 71 of the pushing member 70 may be provided at the first end of the link member 65. The guide projection 67 may be formed, for example, in a cylindrical shape. The link member 65 may serve to change the rotation of the crank arm 61 to the linear movement of the pushing member 70. When the pushing member 70 pushes the developing unit 20, the link member 65 may not apply force directly to the pushing member 70, but may help the elastic member 80 to press the pushing member 70 in a predetermined direction.

The pushing member 70 may be in contact with the lower portion of the developing unit 20, and then may directly push the developing unit 20 in one direction. The pushing member 70 may be disposed to move linearly in the base 50. Accordingly, the base 50 may be provided with a pair of guide rails 51 to guide the pushing member 70.

Figure 8:
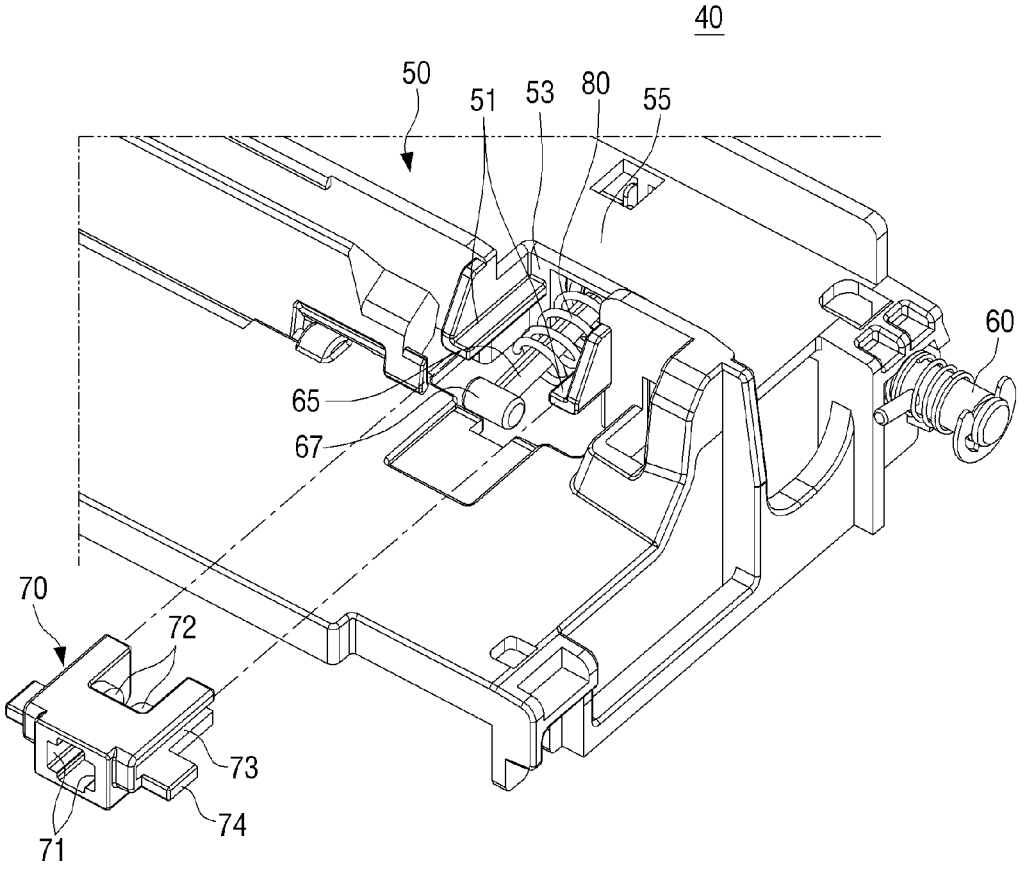
FIG. 8 is a partial perspective view that illustrates a state in which a pushing member is separated from a pushing unit, according to an embodiment of the present inventive concept.

Referring to FIG. 8, the pushing member 70 may be formed, for example, in a substantially hollow rectangular shape, and each of opposite internal side surfaces of the pushing member 70 may be provided with the long groove 71. The pair of long grooves 71 may be formed parallel to the moving direction of the pushing member 70 so that opposite ends of the guide projection 67 of the link member 65 may be inserted and moved in the pair of long grooves 71. The length of the long groove 71 may be determined so that the rotational movement of the crank arm 61 may be changed to the linear movement of the pushing member 70 and the pushing member 70 may be moved a predetermined distance along the link member 65 by an elastic force of the elastic member 80. The pushing member 70 may be moved toward the developing unit 20 by the elastic force of the elastic member 80 being applied to the pushing member 70, and then the developing unit 20 may be rotated on the hinge shaft 25 (see FIG. 3) by the movement of the pushing member 70.

A pair of guide grooves 73 may be provided on opposite external side surfaces of the pushing member 70. The pair of guide grooves 73 may be formed to be inserted in the pair of guide rails 51 provided on the base 50. The pair of guide rails 51 provided on the base 50 may be formed, for example in a shape of rectangular bars to face each other. Accordingly, the pair of guide grooves 73 may be formed, for example, as rectangular grooves that correspond to the rectangular bars. When the pair of guide rails 51 of the base 50 is inserted in the pair of guide grooves 73 of the pushing member 70, the pushing member 70 may be moved linearly along the pair of guide rails 51 of the base 50. In addition, a pair of guide wings 74 may be disposed, for example, below the guide grooves 73 on the opposite side surfaces of the pushing member 70.

The second stopper 53 to limit the movement of the pushing member 70 in one direction may be provided, for example, at an end of at least one of the pair of guide rails 51 of the base 50. The second stopper 53 may limit a distance in which the pushing member 70 may be moved in a direction away from the developing unit 20. As illustrated in FIGS. 4 and 8, the second stopper 53 may be provided, for example, at an end of the guide rail 51 of the base 50 in a direction perpendicular to the guide rail 51.

The front end of the pushing member 70 may be in contact with the lower portion of the developing unit 20 by the elastic member 80. In this case, the pressed portion 23 of the lower portion of the developing unit 20, which is in contact with the pushing member 70, may be formed, for example, in a flat surface. If the pressed portion 23 of the developing unit 20 is formed in a flat surface, the pushing member 70 may be in surface contact with the developing unit 20 since the front end of the pushing member 70, according to the embodiment illustrated in FIGS. 4 and 8, may be formed in a flat surface. Alternatively, the pressed portion 23 of the developing unit 20 and the pushing member 70 may be configured to be in point contact with each other. In this case, the pressed portion 23 of the developing unit 20 or the front end of the pushing member 70 may be formed, for example, in a convex surface.

The elastic member 80 may be disposed with the link member 65, and may elastically support the pushing member 70. For example, the link member 65 may be inserted in the elastic member 80, and may be disposed between the pushing member 70 and the crank arm 61 so that the elastic member 80 may apply a force to the pushing member 70. In other words, a first end of the elastic member 80 may be supported by the one end of the crank arm 61, and a second end of the elastic member 80 may be supported by a rear end of the pushing member 70, specifically, a rear end of a long groove portion 72 in which the long groove 71 may be formed. Because the one end of the crank arm 61 and the rear end of the long groove portion 72 may be formed, for example, in a curve, when the link member 65 is rotated by the crank arm 61, the elastic member 80 may not interfere with the link member 65.

In a state in which the first end of the elastic member 80 is supported by the crank arm 61 and the elastic member 80 is guided by the link member 65, the elastic member 80 may push the pushing member 70 toward the developing unit 20. Accordingly, a coil spring, for example, may be used as the elastic member 80. In this case, the elastic member 80 (e.g., coil spring) may have an elastic force to allow the pushing member 70 to push the pressed portion 23 of the developing unit 20 so that the developing unit 20 may be rotated on the hinge shaft 25, and then the developing member 22 may be in contact with the image carrier 32 of the photosensitive unit 30. In other words, the developing unit 20 may be able to be rotated by only the elastic force of the elastic member 80 (e.g., coil spring) so that the developing member 22 may be in contact with the image carrier 32.

The force which may be applied to the pushing member 70 by the elastic member 80 may vary depending on the rotation of the crank arm 61. As illustrated in FIGS. 4 and 5, when the end of the pushing member 70 is in contact with the second stopper 53, the elastic member 80 may not receive the force. In this case, the elastic member 80 may be in an uncompressed state or in a minimally compressed state. Then, in FIG. 5, as the crank arm 61 is rotated in the clockwise direction, the elastic member 80 may receive the force from the crank arm 61, thereby becoming compressed. When the link member 65 and the crank arm 61 become, for example, a straight line (namely, when the crank arm 61 is positioned at an inflection point), the elastic member 80 may be compressed to the maximum. After that, as the crank arm 61 is rotated over the inflection point, the force being applied to the elastic member 80 may be decreased. Accordingly, when a user rotates the operating lever 69, the user may feel that the force being applied to the operating lever 69 may be increased gradually until the inflection point, and then may be reduced gradually after passing over the inflection point.

Also, because the pushing unit 40, according to an embodiment of the present inventive concept as described above, may use, for example, a slider-crank mechanism, the pushing unit 40 may change the rotational movement to the linear movement in a small space and may be gradually pressed.

Below, operation of the developing apparatus 10, according to an embodiment of the present inventive concept that includes the structure as described above, is described with reference to FIGS. 3 to 9.

First, a case in which the pushing unit 40 may push the developing unit 20 so that the developing member 22 of the developing unit 20 may be in contact with the image carrier 32 of the photosensitive unit 30 is described.

Figure 9:
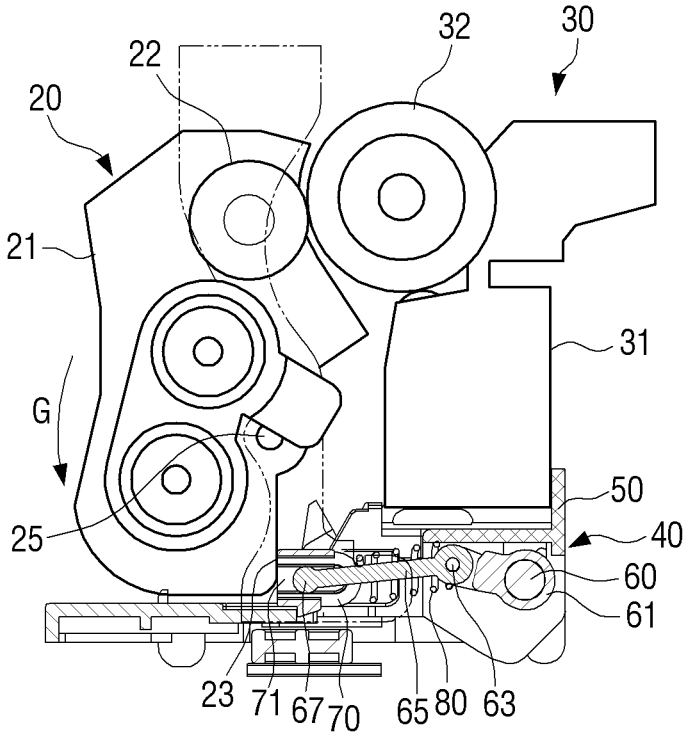
FIG. 9 is a view that illustrates a developing apparatus when a pushing unit, according to an embodiment of the present inventive concept, pushes a developing unit.

When the photosensitive unit 30 is installed in the base 50 of the pushing unit 40, as illustrated in FIG. 3, the developing member 22 of the developing unit 20 may be spaced apart from the image carrier 32 of the photosensitive unit 30. In this case, as the user rotates the operating lever 69 in one direction, the developing unit 20 may be rotated on the hinge shaft 25 so that the developing member 22 may be in contact with the image carrier 32. In the developing apparatus 10, as illustrated in FIG. 3, as the user rotates the operating lever 69 in the clockwise direction, the developing unit 20 may be rotated in the clockwise direction (arrow F) on the hinge shaft 25 so that the developing member 22 may be in contact with the image carrier 32 as illustrated in FIG. 9.

For example, as the user rotates the operating lever 69 in a direction (the direction of an arrow A in FIG. 4), the crank arm 61, integrally fixed to the rotation shaft 60, may be rotated in the same direction (the direction of the arrow A in FIG. 5). When the crank arm 61 is rotated in the direction of the arrow A, the link member 65, connected to the one end of the crank arm 61, may receive a force in an upward direction. Then, the guide projection 67 of the link member 65, which may be inserted in the pair of long grooves 71 formed in the pushing member 70, may be moved along the pair of long grooves 71 in a direction (the direction of an arrow C in FIG. 5). In this case, the elastic member 80, positioned between the pushing member 70 and the crank arm 61, may be gradually compressed according to the rotation of the crank arm 61.

When the crank arm 61 continues to be rotated in the direction of the arrow A so that the link member 65 and the crank arm 61 may form, for example, a straight line (when the link member 65 and the crank arm 61 may be matched with a straight line S as illustrated in FIG. 5), namely, when the crank arm 61 comes to the inflection point, the elastic member 80, in which the link member 65 may be inserted between pushing member 70 and the crank arm 61, may be compressed to the maximum, thereby pressing the pushing member 70 in the direction of the arrow C. In this case, the link member 65 and the crank arm 61 may not apply force to the pushing member 70, and only the elastic force of the elastic member 80 may press the pushing member 70.

If the user continues to rotate the operating lever 69, the upper wall 55 of the base 50 may interfere with the one end of the crank arm 61 so that the crank arm 61 may not be able to rotate further. FIGS. 6 and 7 illustrate when the one end of the crank arm 61 is in contact with the upper wall 55 of the base 50, namely, the first stopper (e.g., the upper wall 55) so that the crank arm 61 may no longer be rotated. In a state in which the crank arm 61 may be in contact with the first stopper (e.g., the upper wall 55), the elastic member 80 may press the pushing member 70. Then, as the lower portion of the developing unit 20 is pushed by the pushing member 70, the developing unit 20 may be rotated in a direction (the direction of an arrow F in FIG. 3) on the hinge shaft 25 so that the developing member 22 and the image carrier 32 may be in contact with each other as illustrated in FIG. 9.

As described above, if the crank arm 61 is in contact with the first stopper (e.g., the upper wall 55) after passing over the inflection point, the crank arm 61 may be prevented from being rotated in the opposite direction by an external force and the developing unit 20 may be released from the compressed state. Accordingly, the elastic force of the elastic member 80 may be determined so that the pushing member 70, which may be pressed by the elastic member 80 in the state in which the crank arm 61 is in contact with the first stopper (e.g., the upper wall 55), may rotate the developing unit 20.

As described above, because the pushing unit 40, according to an embodiment of the present inventive concept, may use a slider-crank mechanism that includes the crank arm 61, the link member 65, and the pushing member 70, the direction in which the pushing member 70 may press the developing unit 20 may be matched with a direction in which the developing unit 20 should be compressed. Also, the pushing unit 40, according to an embodiment of the present inventive concept, may be configured so that the force required to rotate the crank arm 61 may be gradually increased over an entire range in which the crank arm 61 may be rotated. Also, because as the operating lever 69 is rotated, the force may be gradually increased until passing over the inflection point, the user may feel a sense that the operating lever 69 may be locked without use of a separate locking member.

Below, a case in which the developing member 22 may be spaced apart from the image carrier 32 in a state in which the developing member 22 of the developing unit 20 may be in contact with the image carrier 32 of the photosensitive unit 30 as illustrated in FIG. 9 is described.

In order to space the developing member 22 apart from the image carrier 32, the user may rotate the operating lever 69 in the counterclockwise direction (in the direction of an arrow B in FIG. 6).

As the operating lever 69 is rotated in the direction of the arrow B, the crank arm 61, fixed to the rotation shaft 60, may also be rotated in the same direction (the direction of the arrow B in FIG. 7). As the crank arm 61 is rotated in the direction of the arrow B, the link member 65, connected to the one end of the crank arm 61, may receive a force in a downward direction. Then, the pushing member 70 may be moved in a direction (the direction of an arrow D in FIG. 7) by the guide projection 67 inserted in the long groove 71 of the pushing member 70.

When the crank arm 61 is rotated a predetermined angle, the rear end of the pushing member 70 may be in contact with the second stopper 53 provided on the base 50. Then, the crank arm 61 also may not be rotated any more in the direction of the arrow B.

As the pushing member 70 is moved in the direction of the arrow D, the force applied to the lower portion of the developing unit 20, namely, the force with which the elastic member 80 may press the pushing member 70, may be removed so that the developing unit 20 may be rotated in the opposite direction (the direction of an arrow G in FIG. 9), and then may return to the original state as illustrated in FIG. 3. As a result, the developing member 22 of the developing unit 20 may be spaced apart from the image carrier 32 of the photosensitive unit 30. When the developing member 22 is spaced apart from the image carrier 32 as described above, the user may remove the photosensitive unit 30 from the developing unit 20.

Figure 10:
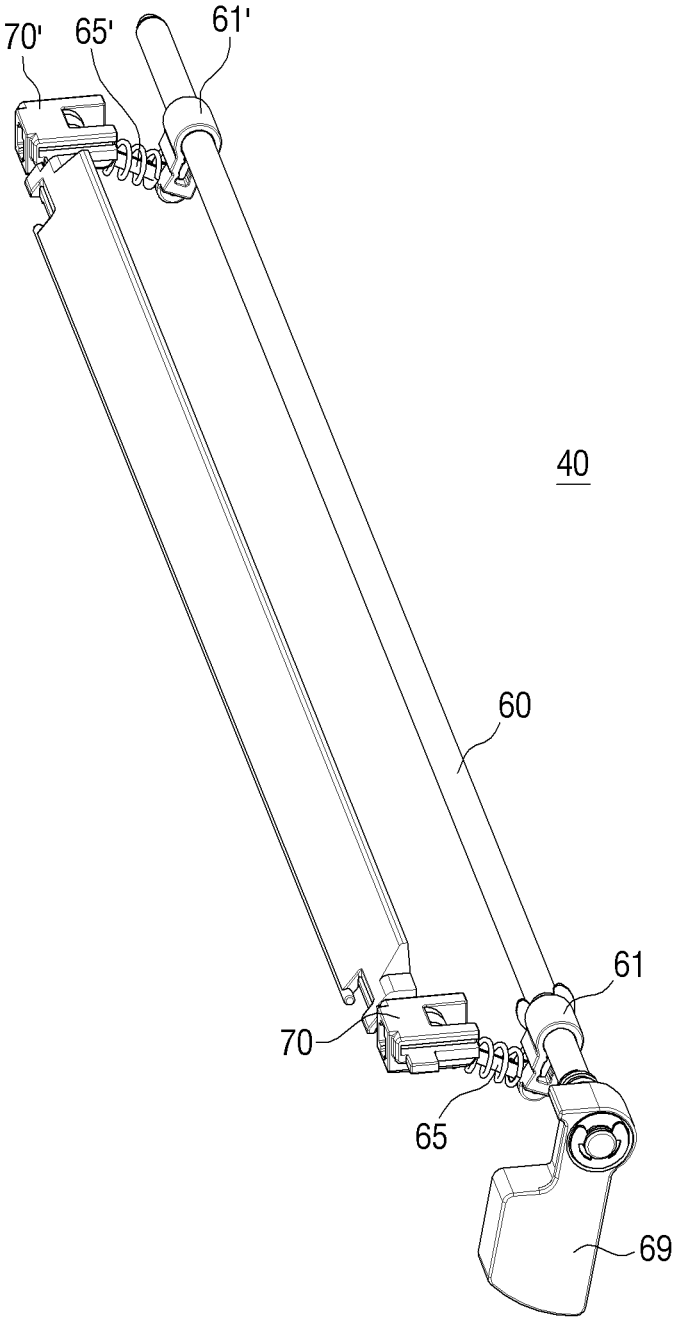
FIG. 10 is a perspective view that illustrates a pushing unit according to an embodiment of the present inventive concept.

In the above description, a single crank arm 61 may be disposed in the rotation shaft 60, and the link member 65 and the pushing member 70 may be connected to the crank arm 61 in order. However, this is only one example. As illustrated in FIG. 10, two crank arms 61 and 61' may be disposed at a certain interval on the rotation shaft 60. In the same way as described above, two link members 65 and 65' and two pushing members 70 and 70' may be connected to each of the two crank arms 61 and 61' in order. Because the pushing unit 40 as illustrated in FIG. 10 may push two points of the developing unit 20 (see FIGS. 3 and 9), the pushing unit 40 illustrated in FIG. 10 may separate the developing unit 20 more smoothly than the pushing unit 40 that has only one pushing member 70.

Below, an image forming apparatus, which has a developing apparatus according to an embodiment of the present inventive concept and includes the structure as described above, is described.

Figure 11:
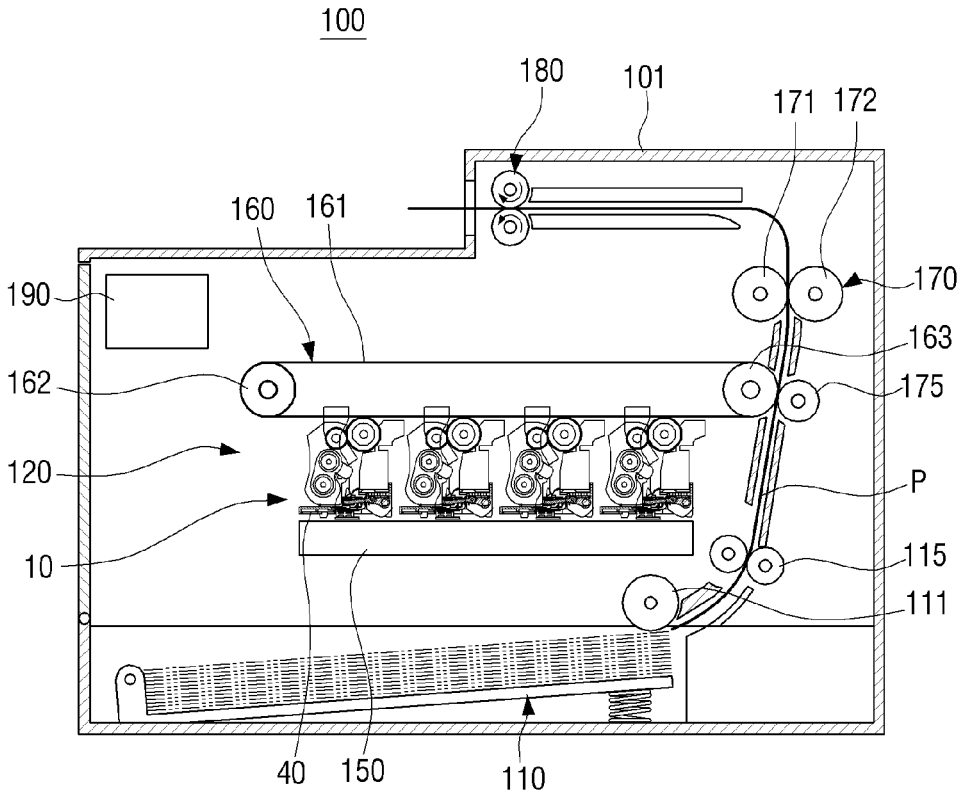
FIG. 11 is a view that schematically illustrates an image forming apparatus that includes a developing apparatus according to an embodiment of the present inventive concept.

Referring to FIG. 11, an image forming apparatus 100, according to an embodiment of the present inventive concept, may include a main body 101, a paper feeding unit 110, an image forming unit 120, a fixing unit 170, a discharging roller 180, and a controller 190.

The main body 101 may form an outward appearance of the image forming apparatus 100. The paper feeding unit 110, the image forming unit 120, the fixing unit 170, the discharging roller 180, and the controller 190 may be disposed inside the main body 101.

The paper feeding unit 110 may accommodate a number of print media P, and may include a pickup roller 111 that may pick up the print media P one by one and may feed the print media P to the image forming unit 120. A feeding roller 115 may be disposed in front of the pickup roller 111 in a direction in which the picked print media P is moved, and may feed the picked print media P to a transfer roller 175.

The image forming unit 120 may form and may transfer predetermined images to the print media P. The image forming unit 120 may include the exposure unit 150, a plurality of developing apparatuses 10, a transfer belt unit 160, and the transfer roller 175.

The exposure unit 150 may form an electrostatic latent image on the image carrier 32 (see FIGS. 3 and 9) of each of the plurality of developing apparatuses 10 by emitting light corresponding to received printing data.

The plurality of developing apparatuses 10 may form a developer image that corresponds to the printing data, and may include, for example, four developing apparatuses 10 to form color images. For example, the four developing apparatuses 10 may form yellow, magenta, cyan, and black developer images.

The transfer belt unit 160 may include an intermediate transfer belt 161, a driving roller 162, and a driven roller 163. The developer images formed on the image carriers 32 (see FIGS. 3 and 9) of the four developing apparatuses 10 may be transferred onto the intermediate transfer belt 161 in an overlapping manner. The intermediate transfer belt 161 may carry the transferred image to the transfer roller 175. The driving roller 162 and the driven roller 163 may support the intermediate transfer belt 161 and may allow the intermediate transfer belt 161 to move along a caterpillar track.

The transfer roller 175 may be disposed at an end of the transfer belt unit 160. The transfer roller 175 may allow the developer image formed on the intermediate transfer belt 161 to be transferred onto the print media P fed, from the paper feeding unit 110, between the transfer roller 175 and the intermediate transfer belt 161.

The fixing unit 170 may include a pressure roller 171 and a heat roller 172 that face each other and may apply pressure and heat to the print media P, thereby fixing the developer image transferred by the transfer roller 175 to the print media P.

The discharging roller 180 may be formed to discharge the print media P, onto which the image is fixed in the fixing unit 170, outside the main body 101 of the image forming apparatus 100.

The controller 190 may form images on the print media P that correspond to the received printing data by controlling the paper feeding unit 110, the exposure unit 150, the plurality of developing apparatuses 10, the transfer belt unit 160, the transfer roller 175, the fixing unit 170, the discharging roller 180, etc.

Accordingly, in the image forming apparatus 100 that has the structure as described above, an image may be transferred on the print media P supplied from the paper feeding unit 110 by the transfer roller 175 of the image forming unit 120, and the print media P with the transferred image may pass through the fixing unit 170 so that the image is fixed onto the print media P. After that, the print media P with the fixed image may be discharged to outside the main body 101 through the discharging roller 180, thereby completing a printing operation.

After the user prints for a period of time by using the image forming apparatus 100 that has the structure as described above, the image carrier 32 (see FIGS. 3 and 9) of the developing apparatus 10 may reach the end of its life. In this case, the user may rotate the operating lever 69 (see FIGS. 4, 6, and 10) of the pushing unit 40 disposed in the main body 101 so that the developing member 22 of the developing unit 20 may be spaced apart from the image carrier 32 of the photosensitive unit 30 (see FIGS. 3 and 9). After that, the user may remove the depleted photosensitive unit 30 from the main body 101, and then may install a new photosensitive unit 30 in the main body 101.

Since the developing apparatus 10, according to an embodiment of the present inventive concept, may push the developing unit 20 by using the slider-crank mechanism and the elastic member 80 (see FIGS. 3-9), when the user rotates the operating lever 69 in order to separate the developing unit 20 from the photosensitive unit 30, force may be gradually increased while rotating the operating lever 69 so that the pushing operation is smooth and stable.

In the above description, the image forming apparatus 100 may include a plurality of developing apparatuses 10. Alternatively, the image forming apparatus 100 may include only one developing apparatus 10. The image forming apparatus 100 that has one developing apparatus 10 has a configuration similar to a conventional black-and-white image forming apparatus except for the structure and operation of the pushing unit 40. Therefore, a detailed description thereof is omitted.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing apparatus, comprising:

a developing unit having a developing member;

a photosensitive unit hinge-connected to the developing unit and having an image carrier; and a pushing unit disposed below the photosensitive unit and configured to selectively push a lower portion of the developing unit, wherein the pushing unit includes:

a pushing member disposed to move linearly in a base and having an end configured to be in contact with the lower portion of the developing unit;

a link member having a first end connected to the pushing member;

a crank arm rotatably connected to a second end of the link member;

an elastic member disposed on the link member and that elastically supports the pushing member; and a rotation shaft rotatably disposed in the base and connected to the crank arm, and wherein the base comprises a pair of guide rails configured to guide a linear movement of the pushing member.

2. The developing apparatus of claim 1, wherein the pushing unit further includes:

an operating lever disposed at an end of the rotation shaft and configured to be rotated integrally with the rotation shaft and the crank arm.

3. The developing apparatus of claim 2, wherein:

when the operating lever is rotated in a direction, the elastic member pushes the pushing member so that the developing unit is rotated by a certain angle, and when the operating lever is rotated in an opposite direction, a force with which the elastic member pushes the pushing member is removed so that the developing unit returns to an original state.

4. The developing apparatus of claim 1, wherein:

an amount of compression of the elastic member is configured to change according to an amount of rotation of the crank arm.

5. The developing apparatus of claim 1, wherein:

the base comprises a first stopper configured to limit a rotational movement of the crank arm.

6. The developing apparatus of claim 1, wherein:

the base further comprises a second stopper disposed at an end of at least one of the pair of guide rails and configured to limit the linear movement of the pushing member.

7. The developing apparatus of claim 1, wherein:

the lower portion of the developing unit and the pushing member are formed to be in surface contact with each other.

8. The developing apparatus of claim 1, wherein:

when the pushing member pushes the developing unit, the developing member is in contact with the image carrier of the photosensitive unit, and when the pushing unit does not push the developing unit, the developing member is spaced apart from the image carrier.

9. A developing apparatus comprising:

a developing unit having a developing member;

a photosensitive unit hinge-connected to the developing unit and having an image carrier; and a pushing unit disposed below the photosensitive unit and configured to selectively push a lower portion of the developing unit, wherein the pushing unit includes:

a pushing member disposed to move linearly in a base and having an end configured to be in contact with the lower portion of the developing unit;

a link member having a first end connected to the pushing member;

a crank arm rotatably connected to a second end of the link member;

an elastic member disposed on the link member and that elastically supports the pushing member; and a rotation shaft rotatably disposed in the base and connected to the crank arm, wherein the pushing member comprises a pair of long grooves formed in a direction parallel to a moving direction of the pushing member, and wherein the link member comprises a guide projection formed at the first end of the link member, inserted in the pair of long grooves, and configured to move inside the pair of long grooves.

10. A developing apparatus comprising:

a developing unit having a developing member;

a photosensitive unit hinge-connected to the developing unit and having an image carrier; and a pushing unit disposed below the photosensitive unit and configured to selectively push a lower portion of the developing unit, wherein the pushing unit includes:

a pushing member disposed to move linearly in a base and having an end configured to be in contact with the lower portion of the developing unit;

a link member having a first end connected to the pushing member;

a crank arm rotatably connected to a second end of the link member;

an elastic member disposed on the link member and that elastically supports the pushing member; and a rotation shaft rotatably disposed in the base and connected to the crank arm, wherein an amount of compression of the elastic member is configured to change according to an amount of rotation of the crank arm, and wherein when the link member and the crank arm form a straight line, the elastic member is compressed to a maximum.

11. A developing apparatus comprising:

a developing unit having a developing member;

a photosensitive unit hinge-connected to the developing unit and having an image carrier; and a pushing unit disposed below the photosensitive unit and configured to selectively push a lower portion of the developing unit, wherein the pushing unit includes:

a pushing member disposed to move linearly in a base and having an end configured to be in contact with the lower portion of the developing unit;

a link member having a first end connected to the pushing member;

a crank arm rotatably connected to a second end of the link member;

an elastic member disposed on the link member and that elastically supports the pushing member; and a rotation shaft rotatably disposed in the base and connected to the crank arm, wherein the base comprises a first stopper configured to limit a rotational movement of the crank arm, and wherein when the crank arm is in contact with the first stopper, the pushing member presses the developing unit with an elastic force of the elastic member so that the developing member is in contact with the image carrier.

12. The developing apparatus of claim 11, wherein:

when the crank arm is in contact with the first stopper, a moving direction of the pushing member is the same as a direction of the elastic force of the elastic member.

13. An image forming apparatus, comprising:

a main body of the image forming apparatus;

a paper feeding unit disposed inside the main body;

an image forming unit having at least one developing apparatus and configured to transfer an image onto a print medium supplied from the paper feeding unit; and a fixing unit configured to fix the image transferred onto the print medium, wherein the at least one developing apparatus comprises:

a developing unit having a developing member;

a photosensitive unit hinge-connected to the developing unit and having an image carrier; and a pushing unit disposed below the photosensitive unit and configured to selectively push a lower portion of the developing unit, wherein the pushing unit includes:

a pushing member disposed to move linearly in a base and having an end configured to be in contact with the lower portion of the developing unit;

a link member having a first end connected to the pushing member;

a crank arm rotatably connected to a second end of the link member;

an elastic member disposed on the link member and that elastically supports the pushing member; and a rotation shaft rotatably disposed in the base and connected to the crank arm, and wherein the base comprises a pair of guide rails configured to guide a linear movement of the pushing member.

* * * * *